US006761573B1

(12) United States Patent
Chiu

(10) Patent No.: US 6,761,573 B1
(45) Date of Patent: Jul. 13, 2004

(54) FLAT AND PLIABLE CIRCUIT BOARD CONNECTOR

(75) Inventor: Hsien Yu Chiu, Taoyuan (TW)

(73) Assignee: P-Two Industries Inc., Taoyuan (TW)

( * ) Notice: Subject to any disclaimer, the term of this patent is extended or adjusted under 35 U.S.C. 154(b) by 0 days.

(21) Appl. No.: 10/677,385

(22) Filed: Oct. 3, 2003

(30) Foreign Application Priority Data

May 20, 2003 (TW) ..... 92113523 A

(51) Int. Cl.[7] ..... H01R 13/15
(52) U.S. Cl. ..... 439/260
(58) Field of Search ..... 439/620, 495, 439/492, 331, 67

(56) References Cited

U.S. PATENT DOCUMENTS 5,906,498 A * 5/1999 Nagafuji ..... 439/260
6,338,648 B1 * 1/2002 Miura et al. ..... 439/495
6,352,442 B1 * 3/2002 Kudo ..... 439/260
6,679,713 B2 * 1/2004 Miura ..... 439/260

* cited by examiner

*Primary Examiner*—Son V. Nguyen
(74) *Attorney, Agent, or Firm*—Birch, Stewart, Kolasch & Birch, LLP

(57) ABSTRACT

A flat and pliable circuit board connector includes an insulated body having a top open space and a plurality of terminals disposed therein, two anchor members mounted on both sides of the housing and an upper lid pivotally connected to the anchor members and upwardly turnable to expose the open space and enable easy insertion of a pliable circuit board into the open space. After the movable upper lid is closed, the pliable circuit board is securely latched in the connector and the upper lid becomes an upper wall of the connector. The movable upper lid is covered by a metal shield plate to prevent electromagnetic interference (EMI) to enhance the performance of the flat and pliable circuit board connector. The upper lid is lifted and opened rearwardly and closed forwardly.

11 Claims, 7 Drawing Sheets

FLAT AND PLIABLE CIRCUIT BOARD CONNECTOR

This nonprovisional application claims priority under 35 U.S.C. § 119(a) on patent application Ser. No. 092113523 filed in TAIWAN on May 20, 2003, which is herein incorporated by reference.

FIELD OF THE INVENTION

The present invention relates to a flat and pliable circuit board connector and particularly to a flat and pliable circuit board connector that has a movable upper lid for opening and closing to provide an open space and exposed terminals to facilitate insertion of the pliable circuit board and also equips function of preventing electromagnetic interference.

BACKGROUND OF THE INVENTION

A conventional pliable circuit board connector 10 generally is constructed like the one shown FIGS. 1 and 2. It mainly includes a rectangular insulation body 20, a rectangular coupling cap 30 and a plurality of terminals 25. The rectangular insulation body 20 is a closed frame structure and includes an upper side wall 21, a lower side wall 22 and a side wall connecting to the left side and the right side of the upper side wall 21 and the lower side wall 22. The front side of the frame has an opening to form an insertion slot 23 to enable a pliable circuit board 15 to insert and enter the interior of the insulation body 20. The rear half section of the frame has a plurality of parallel and spaced ditches 24 to allow the terminals 25 to wedge in to form electric connection with the front sections of the upper legs 26 and lower legs 27 of the terminals 25. The coupling cap 30 has an elongated slot 32 abutting a lip end of the coupling cap 30 so that a rib axle 31 formed in an ellipsoidal cross section on the lip end is wedged between the upper leg 26 of each terminal 25 exposed outside the insulation body 20 and the lower leg 27 to form a pivotal structure for the terminal as shown in FIGS. 1 and 2. Namely, although the coupling cap 30 is located at the rear side of the insulation body 20, it is independent from the frame of the insulation body 20 without assembled. Referring to FIG. 1, when the coupling cap 30 is lifted and opened, the rear section of the upper leg 26 of each terminal 25 is not latched by the rib axle 31 and is in a free condition. Once the pliable circuit board 15 is inserted into the insulation body 20, and electric connection is established on each terminal 25, and the coupling cap 25 is closed over the insulation body 20 on the rear side, the rear section of the upper leg 26 of each terminal 25 is latched by the rib axle 31 of the coupling cap 30 so that the front section of the upper leg 26 is moved downwards due to a levering force to press the pliable circuit board 15 and the pliable circuit board 15 is securely held inside the insulation body 20 without loosening off.

As the insulation body 20 mentioned above adopts a closed frame structure that has the upper side wall 21 and the lower side wall 22, and the terminals 25 are sealed in the frame, the movable cap 30 cannot become the upper side wall of the insulation body 20. The pivotal fulcrum of turning and closing for the coupling cap 30 must be located between the upper leg 26 and the lower leg 27 at the rear half section of the terminals 25, and cannot be located on the frame of the insulation body 20. The space of the coupling cap 30 is restricted. The torque for opening or closing the coupling cap 30 also is limited. The resulting torque is generally smaller, and a greater force is required during operation. For closing, it is moved towards the rear side of the insulation body 20. Overall, operation of the pliable circuit board 10 connector is inconvenient.

Moreover, the conventional pliable circuit board connector 10 does not have the function of preventing electromagnetic interference (EMI). Therefore to add an EMI shielding device is required to enhance the function of the pliable circuit board connector.

SUMMARY OF THE INVENTION

In view of the aforesaid disadvantages, the primary object of the invention is to provide an improved flat and pliable circuit board connector equipped with an open space to make operation of the connector more convenient.

The flat and pliable circuit board connector according to the invention includes an upper side wall formed by a movable upper lid that can be lifted rearwards and closed forwards. To insert the pliable circuit board, the movable upper lid is lifted rearwards to expose the upper leg and lower leg on the front half section of the terminal in an open space. Thus insertion operation of the pliable circuit board from the front end is easy, and the terminal may be inserted correctly to establish electric connection. Then the movable upper lid may be closed to securely hold the pliable circuit board in the flat and pliable circuit board connector without loosening off. Operation is easy and efficient.

Another object of the invention is to provide a flat and pliable circuit board connector that has an open space. There is a pivotal fulcrum located on the rear back section of the flat and pliable circuit board connector for the movable upper lid to open or close, rather than located between the upper leg and lower leg at the rear half section of the terminal. Hence the movable upper lid may be lifted or closed at a longer torque to save effort and make operation simpler. Moreover, the movable upper lid may be covered by a metal shield plate to prevent EMI to enhance the function of the flat and pliable circuit board connector.

Yet another object of the invention is to provide a flat and pliable circuit board connector equipped with an open space in which terminal flutes are formed on the plate of the movable upper lid. The rear end of the plate has a sloping downward structure with the distal end of the flutes forming an axle of an ellipsoidal cross section so that the axle and terminals of selected shapes form a cam shaft mechanism. When the movable upper lid is closed, the ellipsoidal axle generates a downward pressure for the front section of the upper leg of each terminal to enable the pliable circuit board to be firmly inserted in the flat and pliable circuit board connector.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENTS

Figure 1:
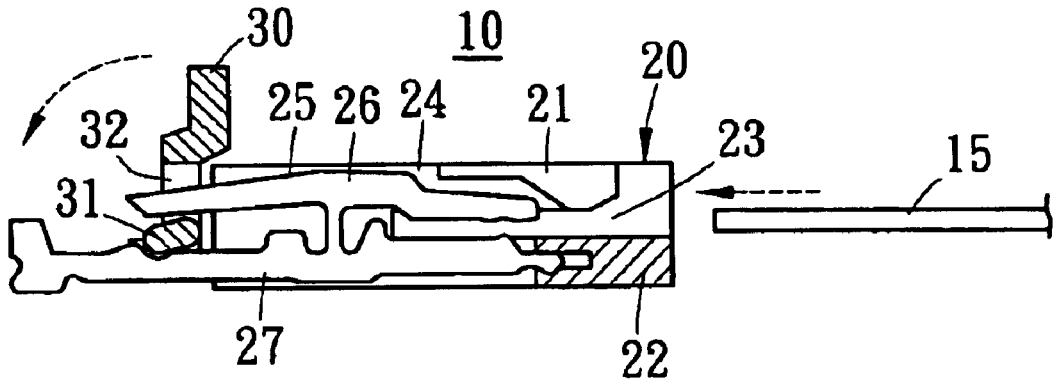
Fig.1 (prior art)
FIGS. 1 and 2 are sectional views of a conventional pliable circuit board connector and a use condition.
Figure 2:
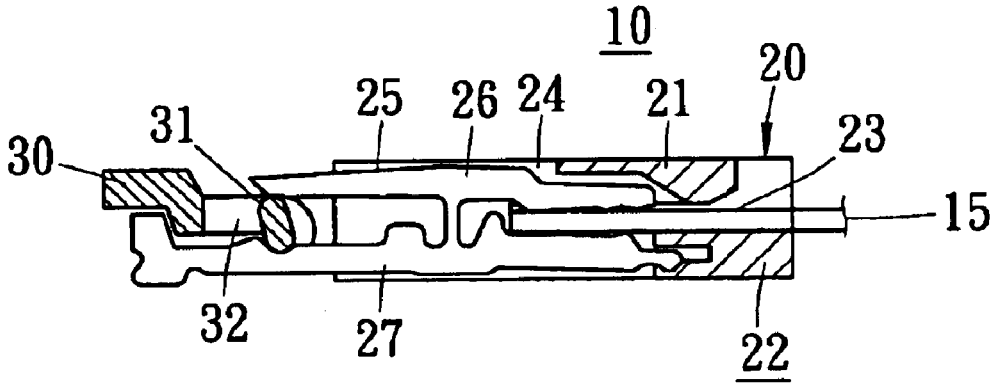
Fig.2 (prior art)

Referring to FIGS. 3 through 6, the flat and pliable circuit board connector 40 of the invention includes an indented body 50 which has an open space 51, a movable upper lid 60 located above the indented body 50 that may be lifted and opened to expose the open space 51 or closed over the indented body to become the upper lid of the indented body 50, a plurality of terminals 70 wedged in the indented body 50, a pair of anchor plates 80 coupling on the left side and the right side of the indented body 50, and a metal shield plate 90 covering the plate 61 of the movable upper lid 60.

Figure 9:
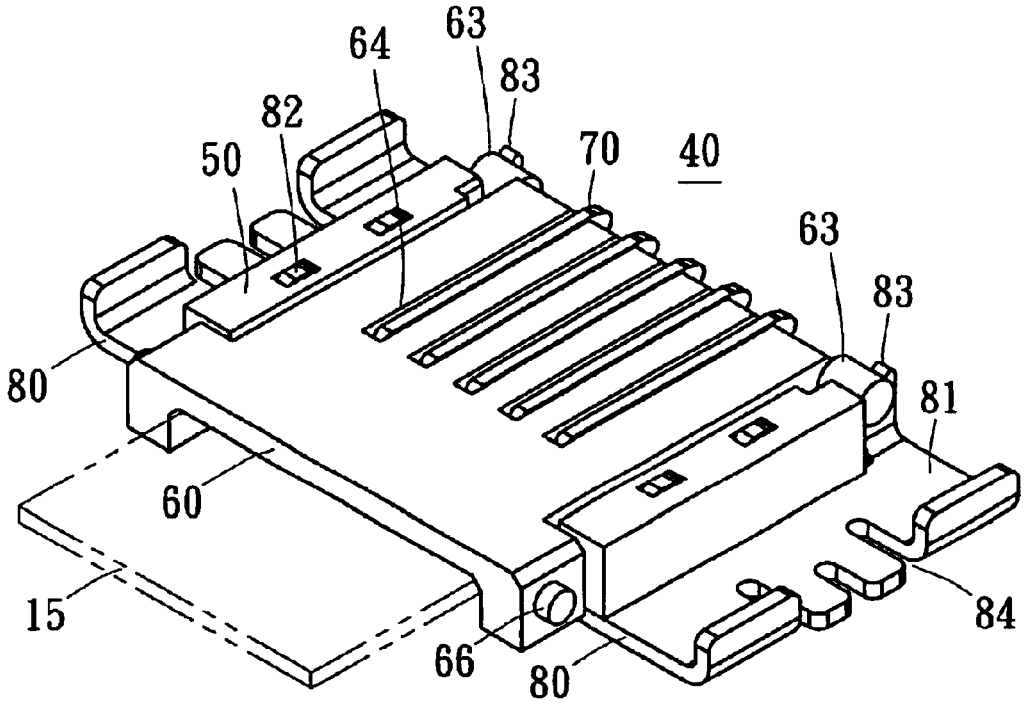
FIG. 9 is a schematic view of the invention with the pliable circuit board inserted and latched securely by the movable upper lid.

Referring to FIG. 9 for another embodiment of the flat and pliable circuit board connector 40 of the invention. It consists of an indented body 50, a movable upper lid 60, a plurality of terminals 70 and a pair of anchor plates 80. In other words, the metal shield plate 90 for preventing EMI is an optional feature which may be selected by users as desired.

Figure 6:
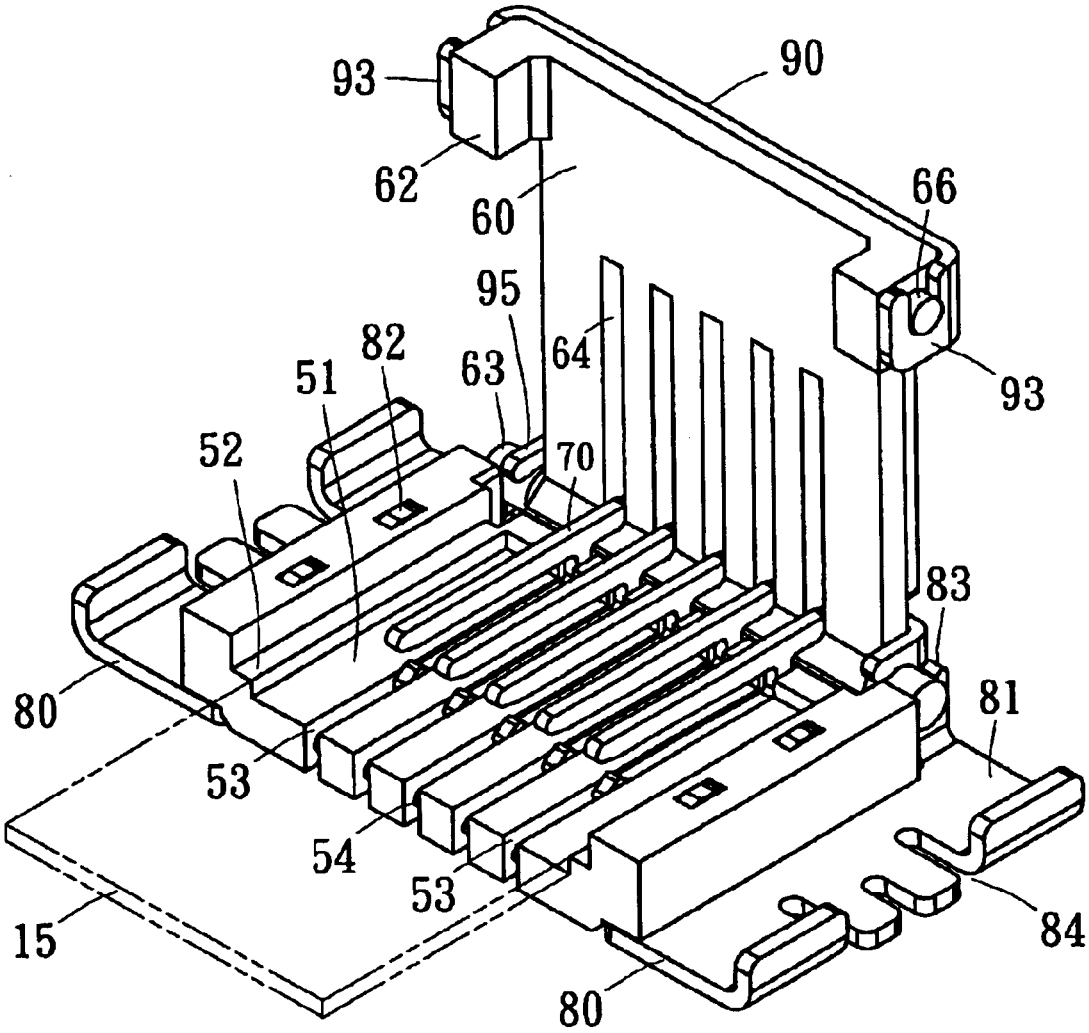
FIG. 6 is a perspective view of the invention with the movable upper lid opened for inserting the pliable circuit board.
Figure 7:
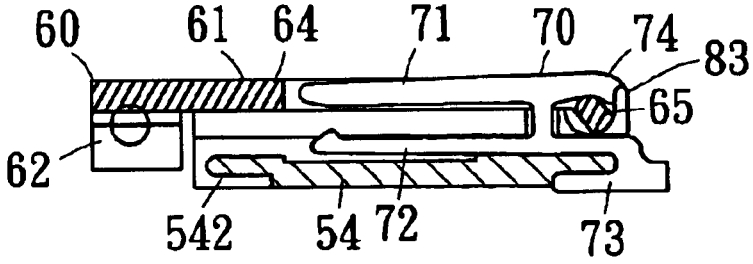
FIG. 7 is a sectional view of the invention with the movable upper lid closed.

The indented body 50 has an exposed open recess to form an open trough 51. The open trough 51 has two side walls each adjacent to a jutting side rib 52 such that the open trough 51 forms a two-stage open space. The upper stage space above the side ribs 52 forms a wider upper space while the side ribs 52 border a narrower lower stage space. Referring to FIGS. 7 and 9, the upper stage space of the open trough 51 provides a closing space for the movable upper lid 60 so that the movable upper lid 60 becomes the upper lid of the indented body 50 after closed. Referring to FIG. 6, the lower stage space of the open trough 51 provides a space for inserting the pliable circuit board 15 to enable the pliable circuit board 15 to form electric connection with the terminals 70.

Figure 5:
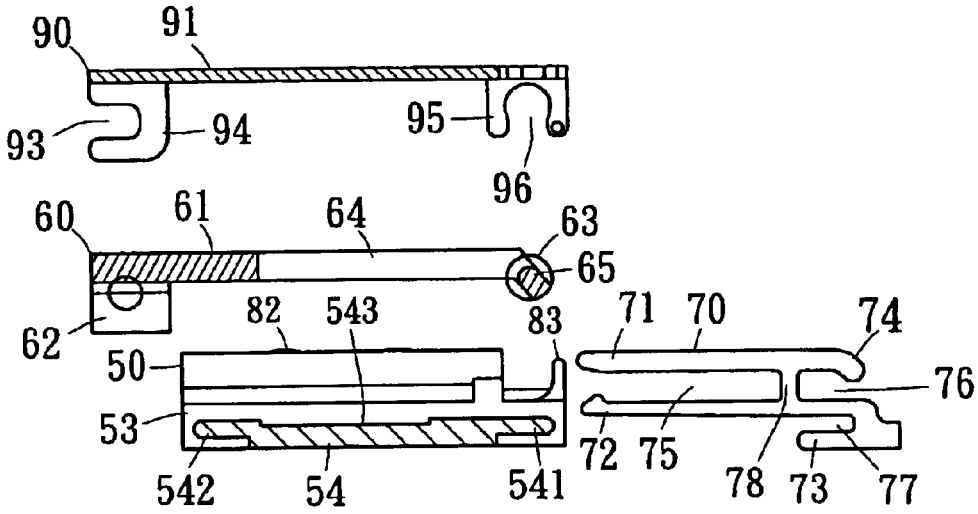
FIGS. 4 and 5 are exploded views of the flat and pliable circuit board connector of the invention.
Figure 10:
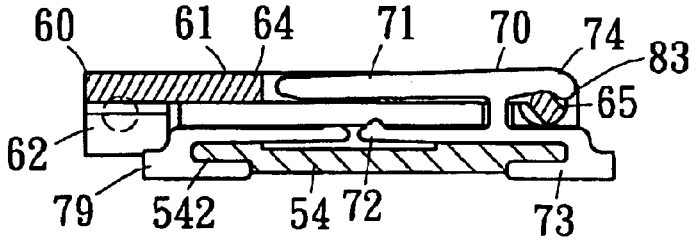
FIG. 10 is a schematic view of the invention showing the indented body coupling with two different types of terminals in the ditches in an alternate manner.

In addition, the surface of the open trough 51 of the indented body 50 has a plurality of ditches 53. Each ditch 53 has a wedge rib 54 formed in a cross section shown in FIG. 5 to couple with the terminal 70 so that the terminal 70 may be wedged in the ditch 53. As shown in FIG. 5, the top surface of the wedge rib 54 has a notch 543 sunk partially. The front end and the rear end of the wedge rib 54 extend respectively to form a tongue-shaped plate to become a rear tenon 541 and a front tenon 542. Such a structure enables the indented body 50 to equip multiple functions. Referring to FIGS. 5, 6 and 7, the rear tenon 541 on the indented body 50 may be coupled with one set of terminal 70 to allow the terminal 70 to be wedged in the ditch 53; or as shown in FIG. 10, the front tenon 542 may be coupled with another set of terminal 70 of a different type in an alternate manner in the ditch 53 of the indented body 50. Hence for accommodating only once set of terminals 70 in the ditches 53 in the indented body 50, the wedge rib 54 may have only the rear tenon 541 without the front tenon 542 thereby to form another embodiment of the indented body 50 with a different structure.

Moreover, there are insert troughs 55 formed on left and right side walls of the indented body 50 to couple with the anchor plates 80 on two sides of the indented body 50.

Figure 4:
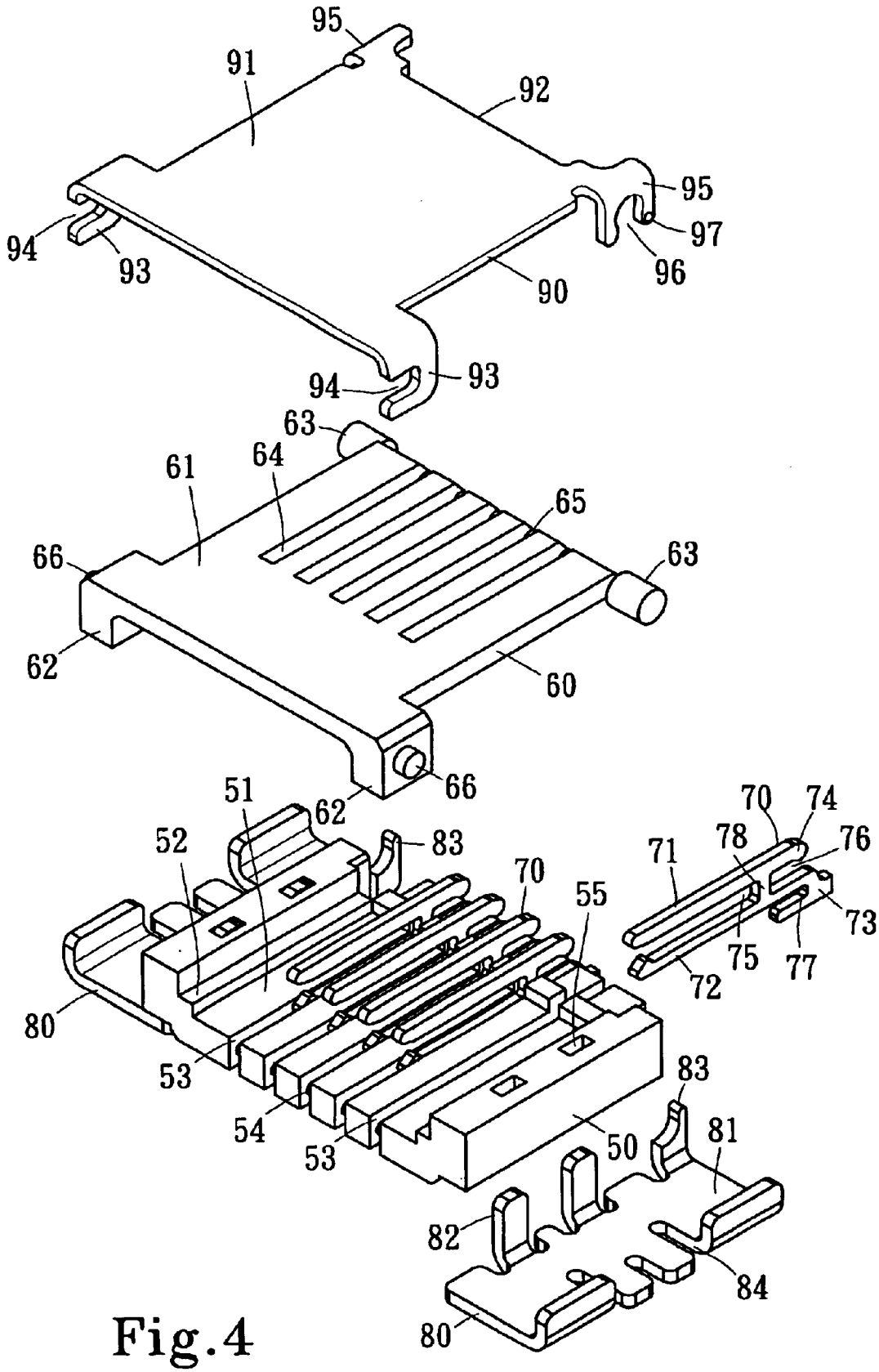

Referring to FIG. 4, the anchor plates 80 are symmetrical left and right. Each anchor plate has a flat surface 81, insert pins 82 extending upwards from the middle section of one side, a bracket arm 83 extending upwards from one end that has an arched notch, and fastening slots 84 directly inwards on the opposite side. The anchor plate 80 may be coupled with the left side and right side of the indented body 50 by inserting the insert pins 82 into the troughs 55 from under the indented body 50. The bracket arm 83 is exposed on the back side of the left and right side walls of the indented body 50 to form a supporting bracket structure as shown in FIGS. 4 and 5 to pivotally engage with stub shafts 63 of the movable upper lid 60.

The fastening slots 84 on the anchor plate 80 allow bolts to pass through to fasten the flat and pliable circuit board connector 40 to a circuit board.

Referring to FIGS. 4, 5 and 7, the terminal 70 generally includes an upper leg 71, a lower leg 72 and a latch leg 73, and forms a latch slot 75, pivot slot 76 and a mortise slot 77 therebetween. The latch leg 73 is connected to a distal end of the rear section of the lower leg 72, and has a front section spaced from the rear section of the lower leg 72 to form the mortise slot 77. The mortise slot 77 may be coupled with the rear tenon 541 of the indented body 50 to enable the terminal 70 to be wedged securely in the ditch 53 of the indented body 50.

Figure 8:
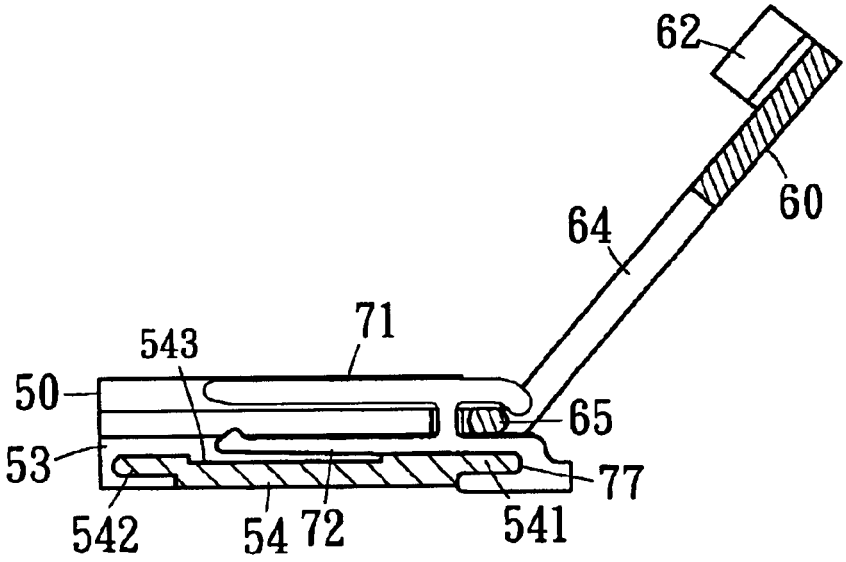
FIG. 8 is a sectional view of the invention with the movable upper lid opened at the maximum angle.

The upper leg 71 and the lower leg 72 are connected by a bridge section 78 to form the latch slot 75 therebetween. When the terminal 70 is wedged in the ditch 53, the latch slot 75 is located in the lower stage open space of the open trough 51 as shown in FIGS. 6, 7 and 8. The upper leg 71 of the terminal 70 is located in the upper stage open space of the open trough 51. Referring to FIG. 6, the latch slot 75 allows the pliable circuit board 15 to insert therein to establish electric connection with the upper leg 71 and the lower leg 72. Referring to FIGS. 7 and 8, the front section of the lower leg 72 is suspended above the notch 543 of the indented body 50 to form a cantilever beam so that it has a flexible strain allowance in a desired range to facilitate insertion of the pliable circuit board 15 into the latch slot 75 of the terminal 70.

The rear sections of the upper leg 71 and the lower leg 72 are spaced from each other to form the pivot slot 76. The distal end of the rear section of the upper leg 71 is bent downwards to form a bent section 74 so that the opening of the pivot slot 76 is narrower to generate a latch effect.

Figure 3:
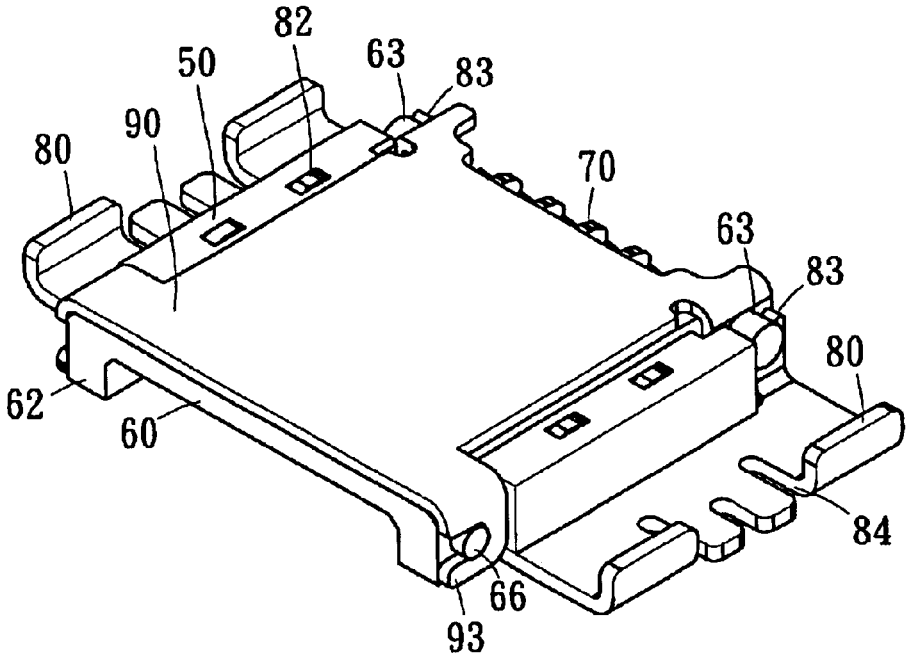
FIG. 3 is a perspective view of the flat and pliable circuit board connector of the invention coupling with a metal shield plate to prevent EMI.

The movable upper lid 60 includes a plate 61 which has a stub shaft 63 extending respectively from the left and right sides of the rear end thereof. The stub shaft 63 has dual functions. Referring to FIGS. 5 through 10, the stub shaft 63 is pivotally coupled with the arched notch of the bracket arm 83 of the anchor plate 80 to form a fulcrum for lifting or closing the movable upper lid 60. Referring to FIGS. 3 and 4, it may also couple with a latch notch 96 formed on the metal shield plate 90.

Referring to FIGS. 4 and 8, the left and right sides of the front end of the plate 61 of the movable upper lid 60 are extended downwards to form a pair of retaining members 62 to enable users to apply force to lift and close the movable upper lid 60. As the movable upper lid 60 uses the stub shafts 63 as the fulcrum that are located on the rear side of the indented body 50, and the force receiving retaining members 62 are spaced from the stub shafts 63 at a maximum distance to form the torque for lifting, the movable upper lid 60 may be lifted and opened in the rear direction, and closed in the front direction easily with less efforts. Moreover, each retaining member 62 has a latch stub 66 extending from a side wall thereof to couple with a latch slot 94 formed on the metal shield plate 90.

Referring to FIG. 5, the rear end of the plate 61 of the movable upper lid 60 is sloped downwards at a desired angle. Such a structure can restrict the movable upper lid 60 to be lifted and opened without exceeding the maximum angle as shown in FIG. 8. In addition, when the open space 51 of the indented body 50 is completely exposed, the pliable circuit board 15 may be easily inserted into the latch slot 75 of the terminal 70.

The plate 61 of the movable lid 60 further has a plurality of flutes 64 corresponding to the ditches 53 of the indented body 50. Each flute 64 has a distal end forming an axle 65 of an ellipsoidal cross section. The narrow section of the axle 65 may be wedged into the pivot slot 76 of the terminal 70. After the stub shafts 63 of the movable upper lid 60 is pivotally engaged with the bracket arm 83.of the anchor plate 80, the axle 65 may be coupled with the pivot slot 76 without escaping.

Referring to FIGS. 7 and 8, when the movable upper lid 60 is turned about the stub shafts 63, the axle 65 and the upper leg 71 of the terminal 70 form a cam shaft mechanism. When the movable upper lid 60 is turned for closing, the ellipsoidal contour of the axle 65 generates a push action on the bent section 74 of the upper leg 71 so that the upper leg 71 uses the bridge section 78 as a fulcrum to produce a levering action to enable the front section of the upper leg 71 to press downwards.

The width of the plate 61 of the movable upper lid 60 is narrower than the upper stage open space of the open trough 51 of the indented body 50, but wider than the lower stage open space of the open trough, and the upper leg 71 is located in the upper stage open space of the open trough 51. Referring to FIGS. 8 and 9, after the movable upper lid 60 is closed, it is in contact with the top surface of the side ribs 52 of the open trough 51 to close the upper stage open space to form the upper lid of the indented body 50. Meanwhile, the upper leg 71 is exposed to the flute 64 of the movable upper lid 60, thereby the thickness of the flat and pliable circuit board connector 40 may be greatly reduced.

Figure 11:
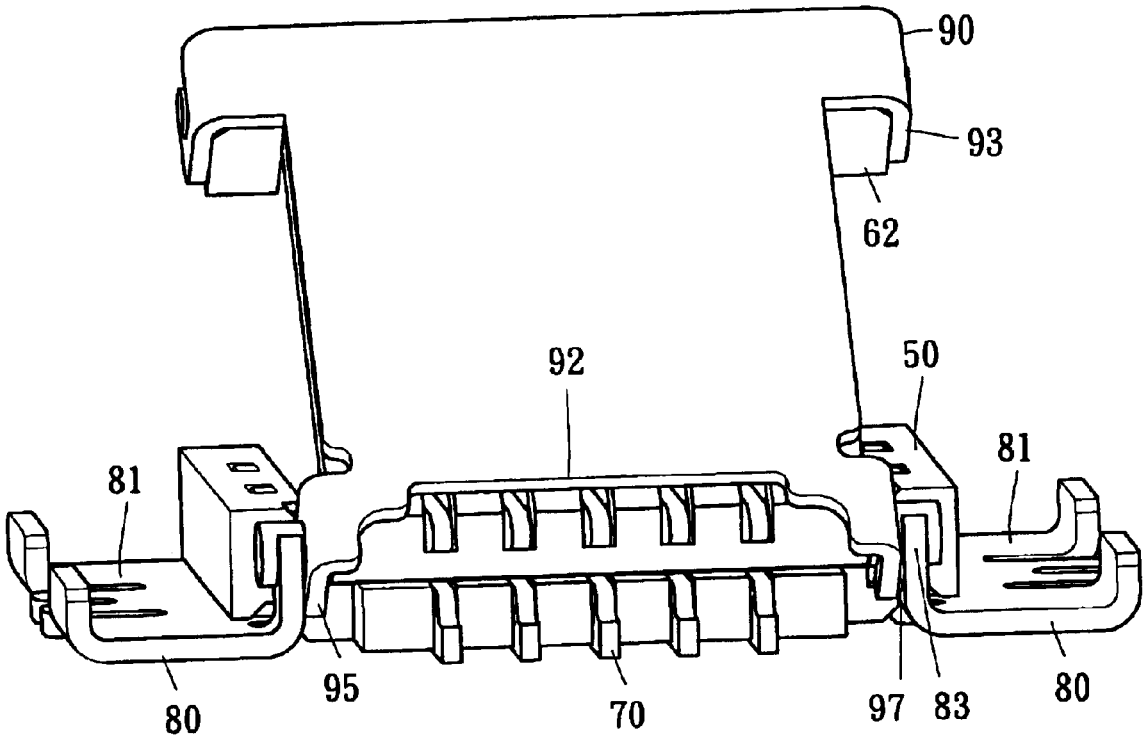
FIG. 11 is a schematic view of the invention showing the movable upper lid opened in another viewing angle.

Referring to FIGS. 3 and 4, the metal shield plate 90 for preventing EMI includes a cover plate 91 formed in a shape corresponding to the plate 61 of the movable upper lid 60. The cover plate 91 has a rear section forming a cut out notch 92. Referring to FIG. 11, when the metal shield plate 90 is covered over the plate 61 of the movable upper lid 60 and the movable upper lid 60 is lifted and opened rearwards, the notch 92 may prevent the metal shield plate 90 from hitting the rear section of the upper leg 71.

The metal shield plate 90 further has respectively a rear flap 95 extending downwards from the left and right sides of the rear end thereof. The rear flap 95 has a latch notch 96 extending downwards to couple with the stub shaft 63 of the movable upper lid 60. The rear flap 95 has a bulged spot 97 on a lower surface abutting the latch notch 96 to generate a gap between the surface of the rear flap 95 and the bracket arm 83 of the anchor plate 80 so that open or close operation of the movable upper lid 60 may be smoothly executed. Moreover, the cover plate 91 further has a front flap 93 extending respectively downwards on the left and right side of the front end. The front flap 93 has a latch slot 94 to couple with the latch stub 66 located on one side of the retaining member 62.

For covering the metal shield plate 90 over the plate 61 of the upper lid 60, first, couple the latch slot 94 with the latch stub 66 of the movable upper lid 60; then latch the latch notch 96 on the stub shaft 63 of the movable upper lid 60. The assembled structure thus made can prevent EMI for the flat and pliable circuit board connector 40.

Referring to FIGS. 6 through 9, for inserting the pliable circuit board 15, first, lift and open the movable upper lid 60 rearwards to the maximum angle to completely expose the open trough 51 of the indented body 50 to facilitate insertion of the pliable circuit board 15; in this condition, the upper leg 71 of the terminal 70 is free from the action of the axle 65 of the movable upper lid 60, and the front section of the upper leg 71 does not press downwards, therefore the pliable circuit board 15 may be inserted easily into the latch slot 75 of the terminal 70 through the open trough 51 of the indented body 50 along the side ribs 52 to form electric connection with the terminal 70; then close the movable upper lid 60 in the forward direction over the open trough 51, the bent section 74 of the upper leg 71 is pressed by the axle 65 of the movable upper lid 60, and the front section of the upper leg 71 is moved downwards to compress and latch the pliable circuit board 15 to form a secured electric connection with the terminal 70. And the pliable circuit board 40 may be securely latched without escaping when in use.

What is claimed is:

1. A flat and pliable circuit board connector, comprising:

an indented body having a front surface, a rear surface, and a top open space to for an open trough extending from the front surface to the rear surface;

a pivotable upper lid liftable for opening and closing the open trough of the indented body;

a plurality of terminals insertable into the indented body; and a pair of anchor members coupling on a left side and a right side of the indented body;

wherein the open trough having an open trough surface and protrusive side ribs formed respectively on a left side and a right side of the open trough surface, a plurality of ditches extending through a top side of the open trough surface, and insert troughs formed on a left side wall and a right side wall of the indented body, each of the ditches having a wedge rib to couple with each of the terminals;

each of the terminals has a upper leg, a lower leg, a vertical bridge section and a latch leg, the latch leg is integrally connected to a distal end of a rear section of the lower leg to form a mortise slot with the lower leg, the bridge section bridging the upper leg and the lower leg to form a latch slot and a pivot slot opposite to the latch slot, wherein the latch slot formed between front sections of the upper leg and the lower leg and the bridge section, and the pivot slot formed between the rear sections of the upper leg and the lower leg and the bridge section, such that the mortise slot is engageable with the wedge rib to allow one of the terminals to be wedged in a corresponding ditch, and the latch slot to be exposed in the top open space of the indented body bordering by the side ribs, and the pivot slot being engageable with one end of the upper lid to allow the lid pivotally moved toward the latch slot;

the upper lid includes a plate in contact with top surfaces of the side ribs when the lid covering the open trough, the plate having stub shafts extending respectively from a left side and a right side of a rear end of the plate, and a plurality of flutes corresponding to the terminals wedged in the ditches of the body; and each of the the anchor members has a flat surface, insert pins integrally extending upwards from one side of the flat surface to couple with the insert troughs of the indented body, and a bracket arm having a notch integrally extending upwards from one end of the one side to couple with one of the stub shafts of the upper lid to form a fulcrum for opening and closing the upper lid.

2. The flat and pliable circuit board connector of claim 1, wherein the plate of the upper lid is covered by a metal shield plate to prevent electromagnetic interference (EMI).

3. The flat and pliable circuit board connector of claim 1, wherein the upper lid has a rear sloped end, each of the flutes have at least one axle located on a distal end thereof.

4. The flat and pliable circuit board connector of claim 3, wherein the upper leg of the terminal has a distal end on a rear section bending downwards to form a bent section.

5. The flat and pliable circuit board connector of claim 1, wherein the wedge rib of the indented body includes a front end and a rear end forming respectively a tongue-shaped tenon.

6. The flat and pliable circuit board connector of claim 1, wherein the wedge rib of the indented body has a notch on the top surface thereof.

7. The flat and pliable circuit board connector of claim 1, wherein the plate of the upper lid has retaining members respectively extending outwards and downwards from a left side and a right side of a front end thereof.

8. The flat and pliable circuit board connector of claim 7, wherein each of the retaining members has a latch stub extending from one side thereof.

9. The flat and pliable circuit board connector of claim 2, wherein the plate of the upper lid has retaining members respectively extending outwards and downwards from a left side and a right side of a front end thereof, and each of the retaining members having a latch stub extending from one side thereof.

10. The flat and pliable circuit board connector of claim 9, wherein the metal shield plate has rear flaps located respectively on a left side and a right side of a rear end thereof, each of the rear flaps having a latch notch.

11. The flat and pliable circuit board connector of claim 10, wherein each of the rear flaps has a bulged spot extending from one side thereof.

* * * * *